US007527522B2

(12) United States Patent
Kondou

(10) Patent No.: US 7,527,522 B2
(45) Date of Patent: May 5, 2009

(54) CONNECTOR ASSEMBLY

(75) Inventor: Takahiro Kondou, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/496,498

(22) Filed: Aug. 1, 2006

(65) Prior Publication Data

US 2007/0087623 A1 Apr. 19, 2007

(30) Foreign Application Priority Data

Oct. 14, 2005 (JP) ..... 2005-299748

(51) Int. Cl.
*H01R 13/73* (2006.01)

(52) U.S. Cl. ..... 439/552; 439/544

(58) Field of Classification Search ..... 439/544, 439/545, 550, 552, 556, 555, 557, 562, 565, 439/567, 569
See application file for complete search history.

(56) References Cited

U.S. PATENT DOCUMENTS 5,833,494 A * 11/1998 Diaz ..... 439/573
6,206,731 B1 * 3/2001 Kuo ..... 439/610
6,231,385 B1 * 5/2001 Kuo ..... 439/557
6,755,686 B2 * 6/2004 Scherer et al. ..... 439/564
6,851,978 B2 * 2/2005 Akama et al. ..... 439/607
2007/0087623 A1 * 4/2007 Kondou ..... 439/542

FOREIGN PATENT DOCUMENTS

| | | |
|---|---|---|
| JP | 11-026097 | 1/1999 |
| JP | 2001-291551 | 10/2001 |
| JP | 2004-111249 | 4/2004 |

* cited by examiner

*Primary Examiner*—James Harvey
(74) *Attorney, Agent, or Firm*—Staas & Halsey LLP

(57) ABSTRACT

A connector assembly is disclosed that includes a first connector provided at an end of a printed board of an electronic apparatus, the first connector having a connector main body part thereof projecting from an opening in the panel of the electronic apparatus; a second connector provided at an end of a cable, the second connector being fitted and connected to the connector main body part of the first connector; and a latch part to which a latch claw of the second connector is latched, the latch part being provided on the panel. The latch claw of the second connector is latched to the latch part on the panel so that the second connector is connected to the first connector.

1 Claim, 9 Drawing Sheets

60
50
51
40A
71A
70
74
14
73
13
10
F
X1
X2
Y1
Y2
72
42
43

71B
80
91
14
83
13
72B
82
40A
43
42
60
91
14
83
13
X1
Y1
Y2
X2
50
51
F
84
14
13
92
10
40A
71B
70

CONNECTOR ASSEMBLY

BACKGROUND OF THE INVENTION

1. Field of the Invention

The present invention relates generally to connector assemblies, and more particularly to a connector assembly having a connector structure where a board-side connector provided at an end of the printed board of an electronic apparatus is connected to a cable-side connector provided at an end of a cable.

2. Description of the Related Art

FIGS. 1 and 2 are diagrams for illustrating a conventional cable-side-connector-to-board-side-connector connection structure, showing a cable-side connector 10 and a board-side connector 40. FIG. 3A shows a state where the cable-side connector 10 is connected to the board-side connector 40. FIG. 3B is an enlarged view of the circled part of FIG. 3A. In each drawing, $X_1$-$X_2$ indicates the widthwise directions of the cable-side connector 10 and the board-side connector 40, $Y_1$-$Y_2$ indicates the lengthwise directions of the cable-side connector 10 and the directions in which the contacts of the board-side connector 40 extend, and $Z_1$-$Z_2$ indicates the vertical (height) directions of the cable-side connector 10 and the board-side connector 40. Further, $Y_1$ indicates the direction in which the cable-side connector 10 is connected to the board-side connector 40.

The cable-side connector 10 has a connector module 12 and latch claws 13 provided in a shield cover assembly 30, and has a pull tab 15 projecting backward (in the $Y_2$ direction). The cable-side connector 10 is connected to an end of the cable 11. The cable-side connector 10 has a plate-like insertion part 18 on which contacts are arranged in the center of an enclosure part 31 formed by a shield cover on the $Y_1$ side of the cable-side connector 10. Further, the cable-side connector 10 has end hook parts 14 of the latch claws 13 positioned on the $X_1$ and $X_2$ sides outside the enclosure part 31. When the pull tab 15 is pulled, the latch claws 13 on both sides deform so that their respective hook parts 14 are displaced in the $X_1$ and $X_2$ directions so as to move away from each other.

The board-side connector 40 has a connector main body part 43. The connector main body part 43 has a main body 41, which is a resin molded article. Contacts 50 are incorporated in the main body 41 in parallel arrangement. The connector main body part 43 projects in the $Y_2$ direction, and is covered with a shield member 42. Latch metal fittings 45 and 46 project in the $Y_2$ direction from the $X_2$ end part and the $X_1$ end part, respectively, of the main body 41. The connector main body part 43 has a shape corresponding to that of the enclosure part 31. The connector main body part 43 has a recess 44 in its center. First ends of the contacts 50 are arranged in the recess 44. As shown in FIG. 2, second ends (the other ends) 51 of the contacts 50 are arranged on the rear side of the main body 41.

The board-side connector 40 is provided at an end of a printed board 60 by fitting a leg part 45*a* of the latch metal fitting 45 into a hole in the printed board 60 and soldering the other ends 51 of the contacts 50 to corresponding pads on the printed board 60.

A housing 70 of an electronic apparatus has a panel 71. An opening 72 corresponding to the board-side connector 40 is formed in the panel 71.

As shown in FIG. 2, the printed board 60 on which the board-side connector 40 is provided is incorporated in the housing 70 of the electronic apparatus with the connector main body part 43 and the latch metal fittings 45 and 46 projecting in the $Y_2$ direction from the opening 72.

As shown in FIGS. 3A and 3B, by pressing the cable-side connector 10 in the $Y_1$ direction against the board-side connector 40, the insertion part 18 is fitted into the recess 44 so that the contacts of the cable-side connector 10 come into contact with the corresponding contacts 51 of the board-side connector 40, and the enclosure part 31 is fitted around the connector main body part 43. Thus, the cable-side connector 10 is connected to the board-side connector 40 with the hook parts 14 being engaged with and latched to the latch metal fittings 45 and 46.

Even when the cable 11 is pulled, the cable-side connector 10 is not removed from the board-side connector 40 because the hook parts 14 are engaged with the latch metal fittings 45 and 46.

Reference may be made to Japanese Laid-Open Patent Application No. 2004-111249 for the above-described technique.

According to the above-described connector connection structure, the latch metal fittings 45 and 46 are provided on the board-side connector 40. Therefore, if the cable 11 catches something and is pulled hard, this force F acts directly on the board-side connector 40 through the latch metal fittings 45 and 46. Therefore, depending on situation, the board-side connector 40 may be damaged, or too much force may act on the soldered parts of the other ends 51 of the contacts 50 and the pads on the printed board 60 so as to cause cracks therein, thus causing poor electrical connection.

SUMMARY OF THE INVENTION

Embodiments of the present invention may solve or reduce one or more of the above-described problems.

In an embodiment of the present invention, there is provided a connector assembly having a connection structure in which the above-described problems are solved.

In an embodiment of the present invention, there is provided a connector assembly including a first connector provided at an end of a printed board of an electronic apparatus, the first connector having a connector main body part thereof projecting from an opening in a panel of the electronic apparatus; a second connector provided at an end of a cable, the second connector being fitted and connected to the connector main body part of the first connector; and a latch part to which a latch claw of the second connector is latched, the latch part being provided on the panel, wherein the latch claw of the second connector is latched to the latch part on the panel so that the second connector is connected to the first connector.

According to one aspect of the present invention, a latch claw of a cable-side connector is latched to the panel of an electronic apparatus. Therefore, even if a cable is pulled improperly hard, the force is received by the panel of the electronic apparatus, and does not reach a board-side connector provided at an end of a printed board of the electronic apparatus. Accordingly, the soldered part of the board-side connector and the printed board (that is, part of the board-side connector soldered to the printed board and part of the printed board soldered to the board-side connector) is prevented from being adversely affected.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 4:
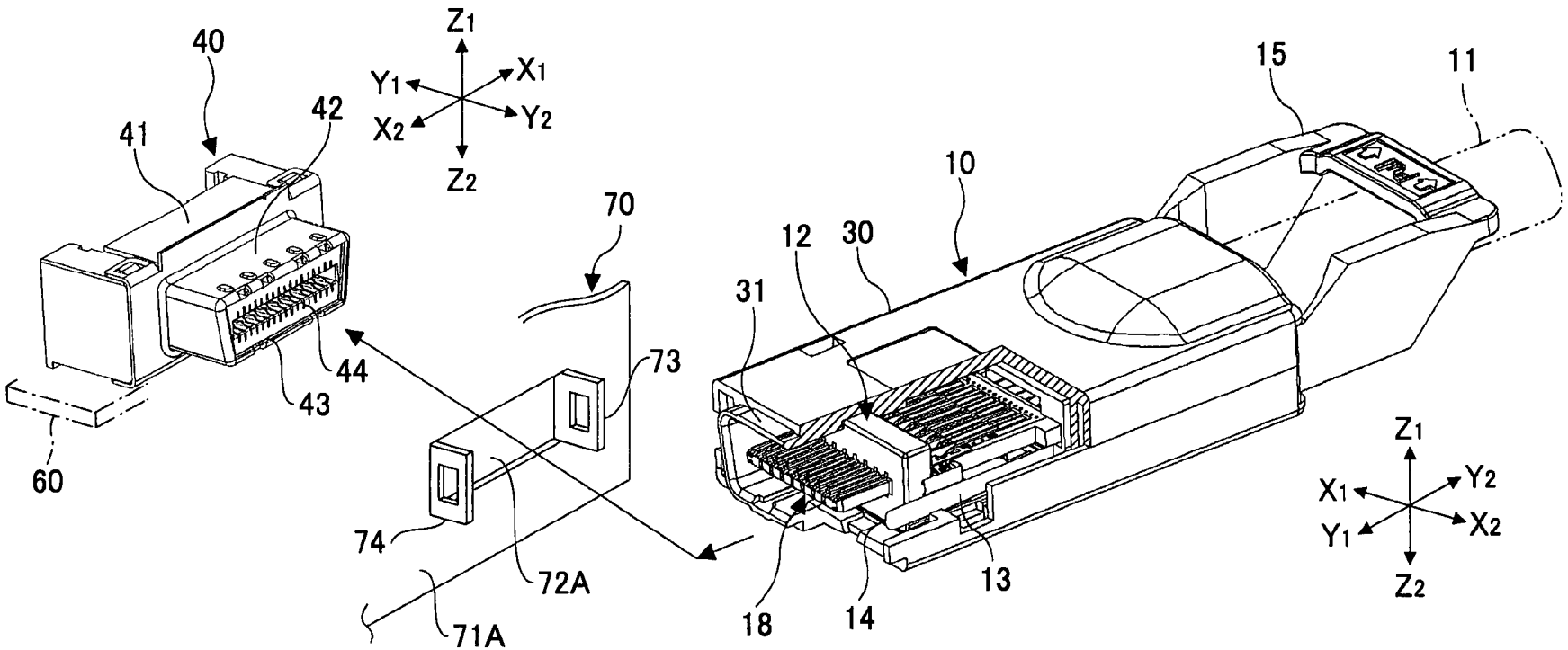
FIG. 4 is a perspective view of a connector connection structure according to a first embodiment of the present invention, showing the cable-side connector and a board-side connector.
Figure 5:
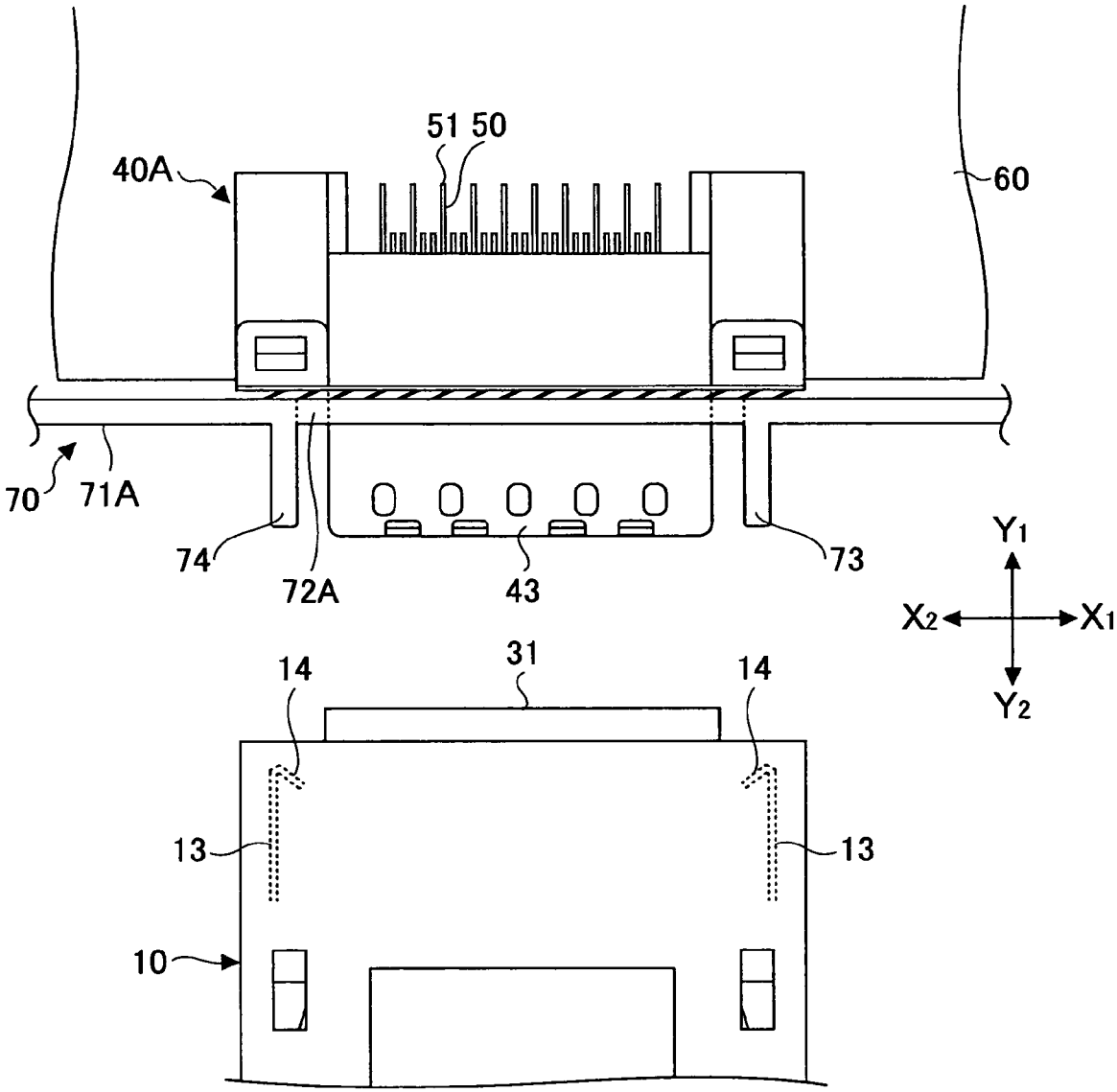
FIG. 5 is a plan view of the connector connection structure according to the first embodiment of the present invention, showing the cable-side connector and the board-side connector opposing each other.
Figures 6A, 6B:
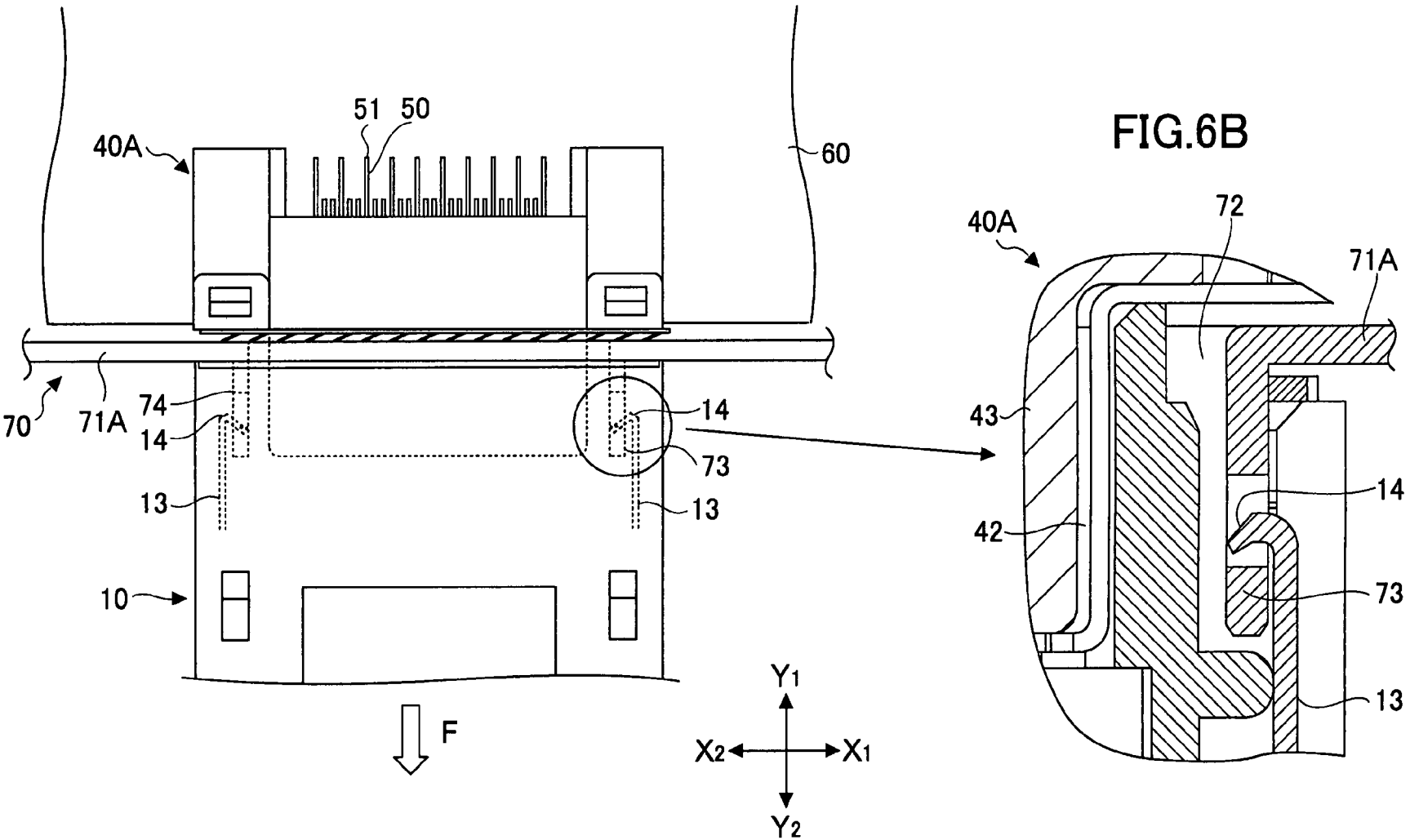
FIG. 6A is a plan view showing a state where the cable-side connector is connected to the board-side connector and is latched.
FIG. 6B is an enlarged cross-sectional view of part of FIG. 6A according to the first embodiment of the present invention.

FIGS. 4 and 5 are diagrams for illustrating a connector connection structure according to a first embodiment of the present invention, showing the cable-side connector 10 and a board-side connector 40A. FIG. 6A shows a state where the cable-side connector 10 is connected to the board-side connector 40A. FIG. 6B is an enlarged view of the circled part of FIG. 6A. In each drawing, $X_1$-$X_2$ indicates the widthwise directions of the cable-side connector 10 and the board-side connector 40A, $Y_1$-$Y_2$ indicates the lengthwise directions of the cable-side connector 10 and the directions in which the contacts of the board-side connector 40A extend, and $Z_1$-$Z_2$ indicates the vertical (height) directions of the cable-side connector 10 and the board-side connector 40A. Further, $Y_1$ indicates the direction in which the cable-side connector 10 is connected to the board-side connector 40A.

In the connector connection structure according to the first embodiment of the present invention, the cable-side connector 10 is the same as in the conventional connection structure, but the board-side connector 40A is different from that of the conventional connection structure.

In the drawings, the same elements as those described above are referred to by the same numerals, and a description thereof is omitted.

Figure 1:
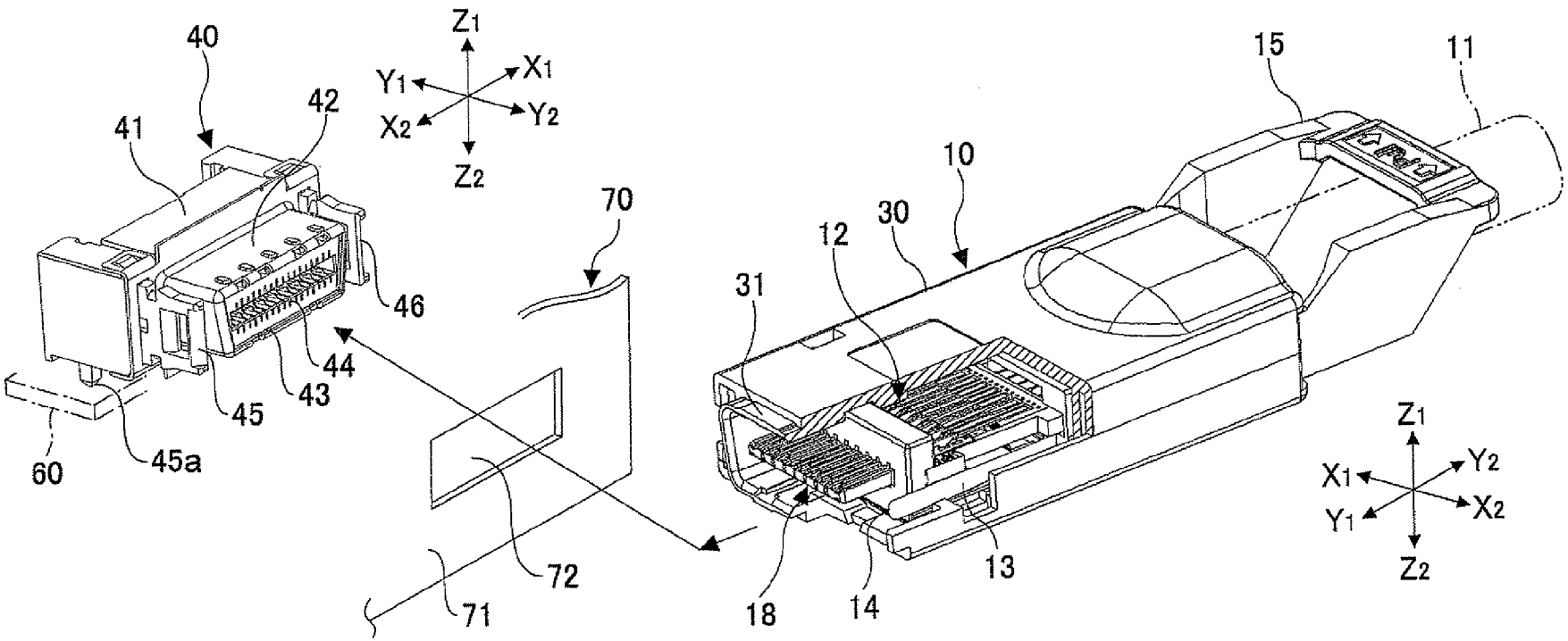
FIG. 1 is a perspective view of a conventional connector connection structure, showing a cable-side connector and a board-side connector.
Figure 2:
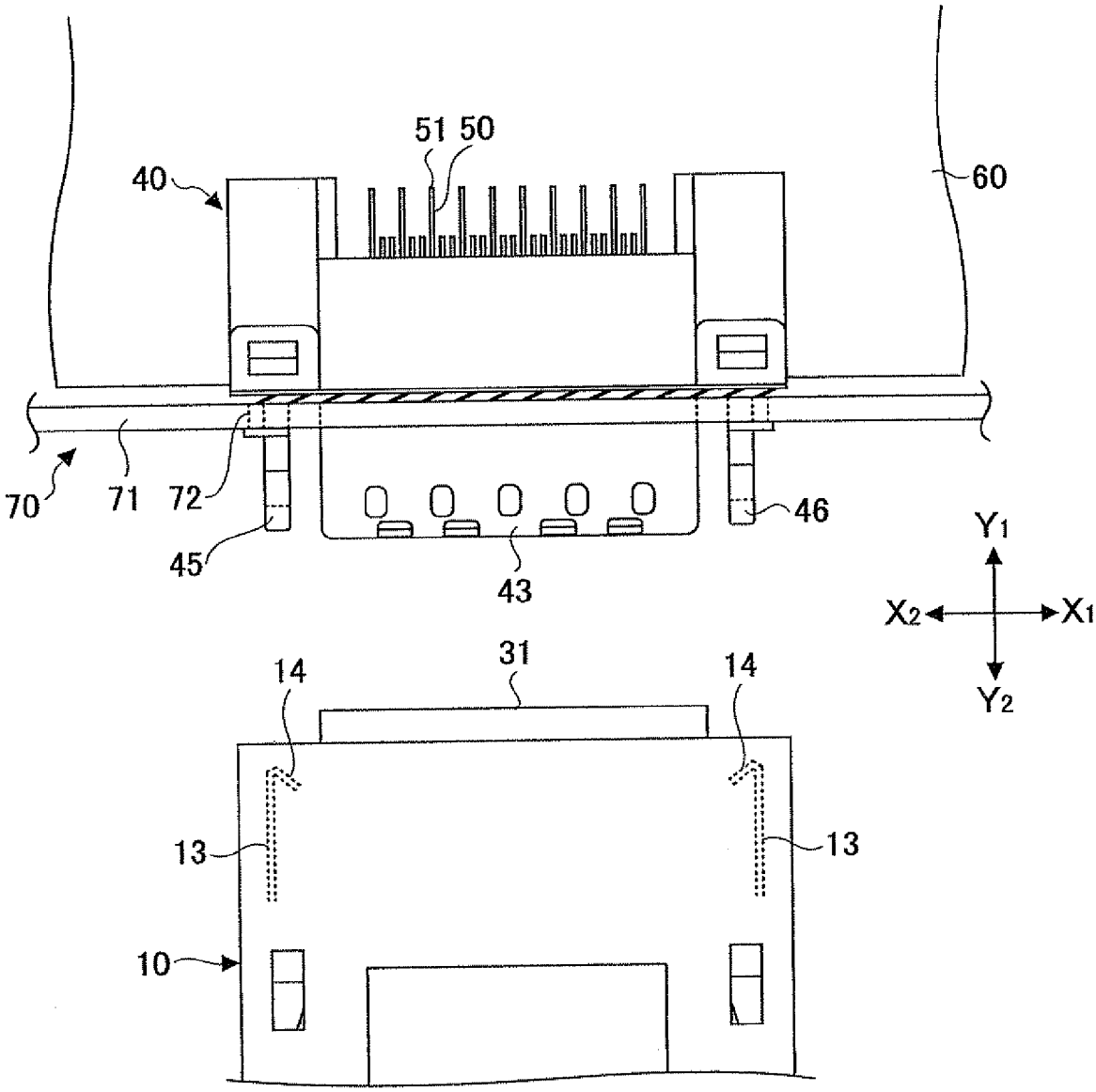
FIG. 2 is a plan view of the conventional connector connection structure, showing the cable-side connector and the board-side connector opposing each other.
Figure 3B:
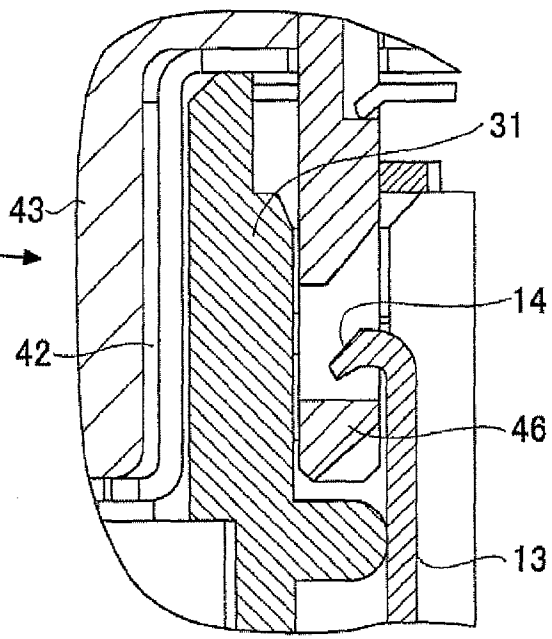
PRIOR ART FIG.3B
FIG. 3B is an enlarged cross-sectional view of part of FIG. 3A.
Figure 3A:
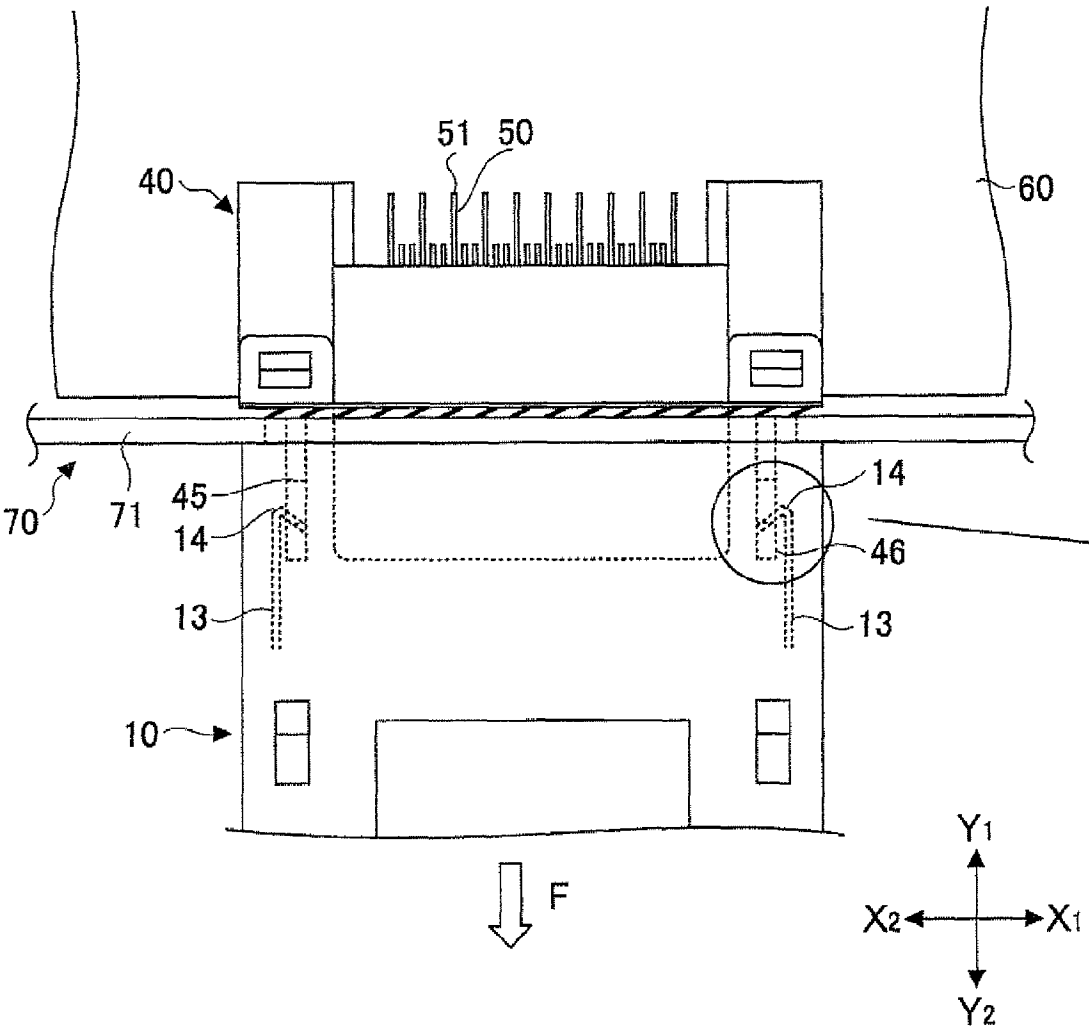
PRIOR ART FIG.3A
FIG. 3A is a plan view showing a state where the cable-side connector is connected to the board-side connector and is latched.

The board-side connector 40A is configured by removing the latch metal fittings 45 and 46 from the board-side connector 40 shown in FIG. 1.

The housing 70 of the electronic apparatus has a panel 71A. An opening 72A corresponding in size to the connector main body part 43 of the board-side connector 40A is formed in the panel 71A. Further, latch metal parts 73 and 74 are formed by press forming on the $X_1$ side and the $X_2$ side, respectively, of the opening 72A on the panel 71A so as to project in the $Y_2$ direction.

These latch metal parts 73 and 74 are formed in relation to the configuration where the board-side connector 40A has no latch metal fittings. The latch metal parts 73 and 74 are formed unitarily with the panel 71A.

As shown in FIGS. 4 and 5, the board-side connector 40A is provided at the end of the printed board 60 by soldering the other ends 51 of the contacts 50 to the pads on the printed board 60.

As shown in FIG. 5, the printed board 60 on which the board-side connector 40A is provided is incorporated in the housing 70 of the electronic apparatus, so that the connector main body part 43 projects in the $Y_2$ direction from the opening 72A so as to be positioned between the latch metal parts 73 and 74.

As shown in FIGS. 6A and 6B, by pressing the cable-side connector 10 in the $Y_1$ direction against the board-side connector 40A, the insertion part 18 is fitted into the recess 44 so that the contacts of the cable-side connector 10 come into contact with the corresponding contacts 51 of the board-side connector 40A, and the enclosure part 31 is fitted around the connector main body part 43. Thus, the cable-side connector 10 is connected to the board-side connector 40A with the hook parts 14 being engaged with and latched to the latch metal parts 73 and 74.

Even when the cable 11 is pulled, the cable-side connector 10 is not removed from the board-side connector 40A because the hook parts 14 are engaged with the latch metal parts 73 and 74. If the cable 11 catches something and is pulled improperly hard, this force F acts on the latch metal parts 73 and 74, and is prevented from acting on the board-side connector 40A. Therefore, no unwanted force acts on the soldered part of the other ends 51 of the contacts 50 and the pads on the printed board 60, so that the electrical connection between the contacts 50 and the printed board 60 is maintained with high reliability.

The cable-side connector 10 and the board-side connector 40A may form a connector assembly with the illustrated connection structure.

Second Embodiment

Figure 7:
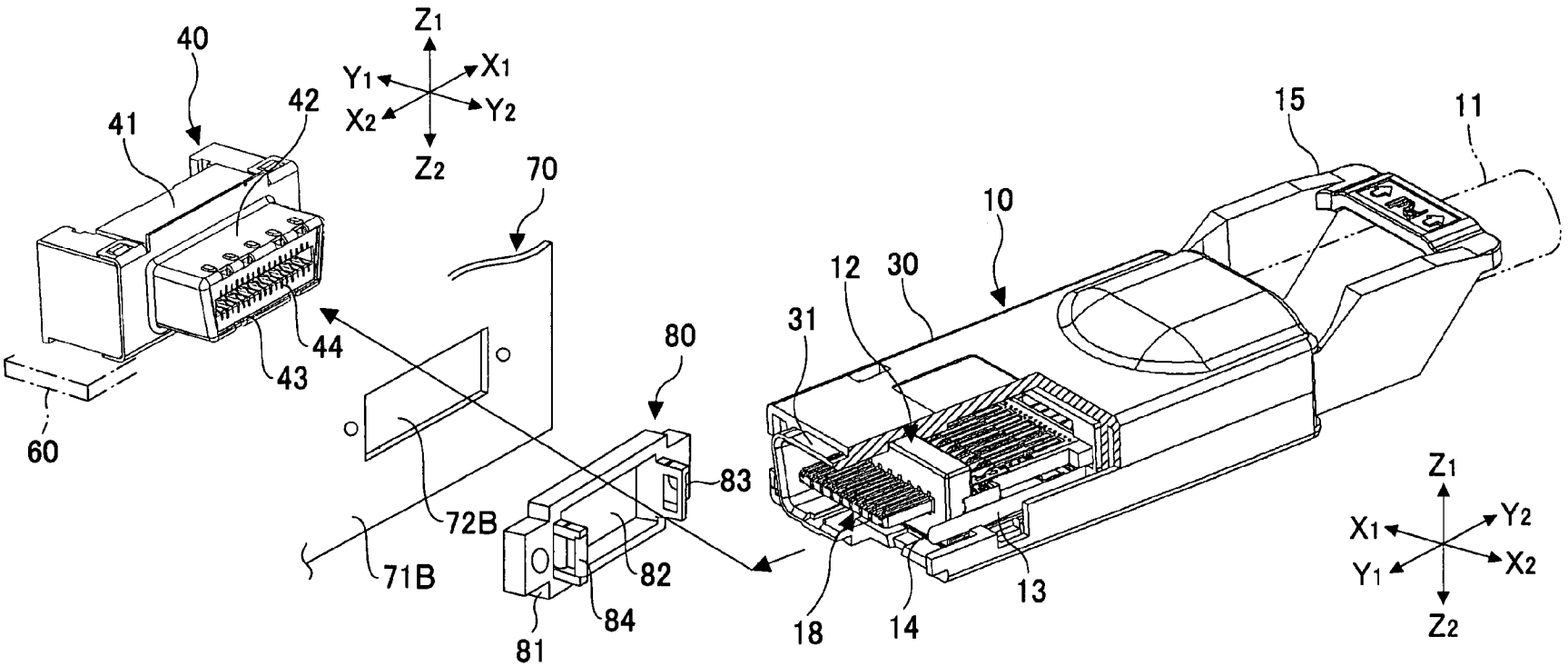
FIG. 7 is a perspective view of a connector connection structure according to a second embodiment of the present invention, showing the cable-side connector and the board-side connector.
Figure 8:
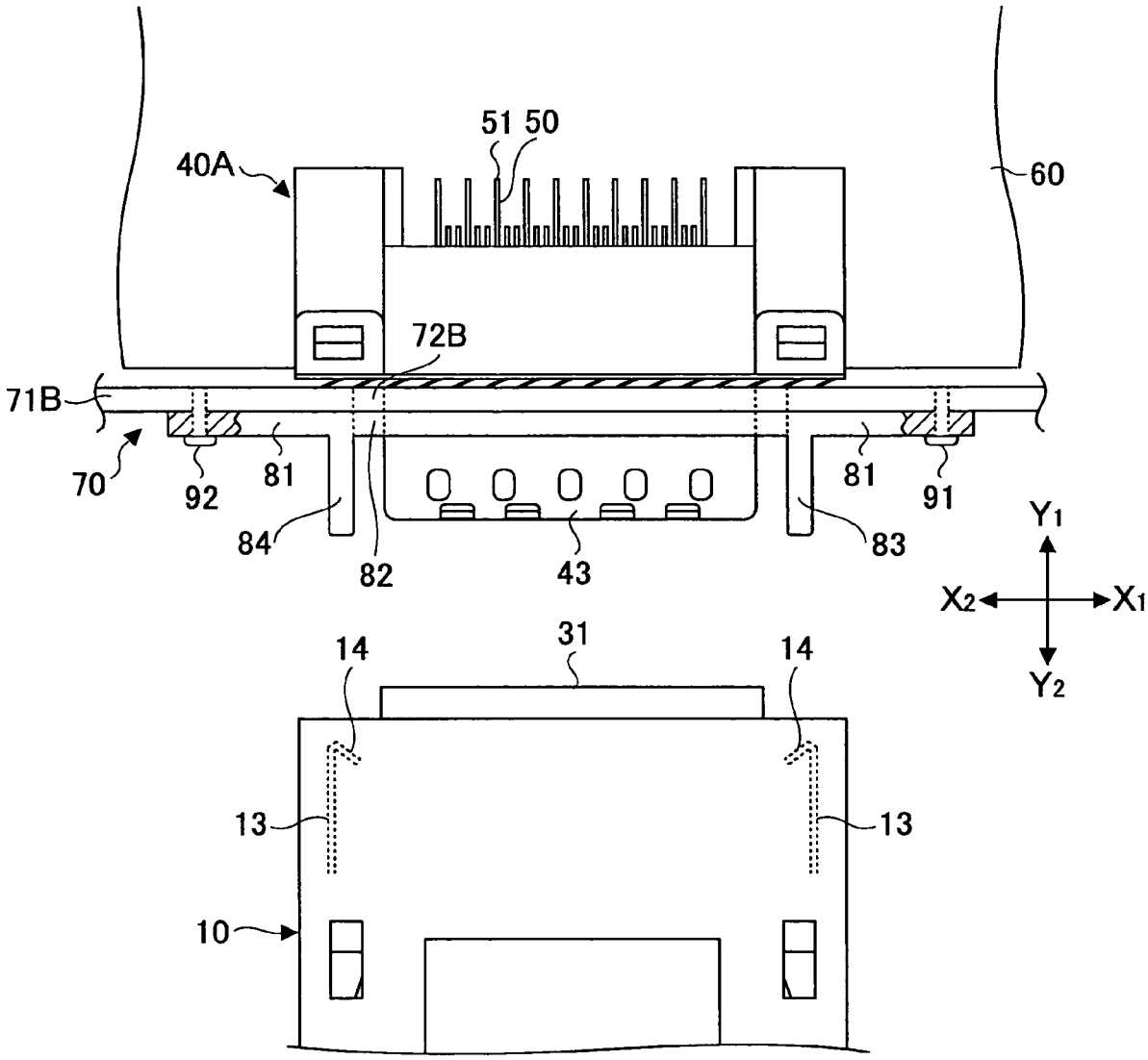
FIG. 8 is a plan view of the connector connection structure according to the second embodiment of the present invention, showing the cable-side connector and the board-side connector opposing each other.
Figures 9A, 9B:
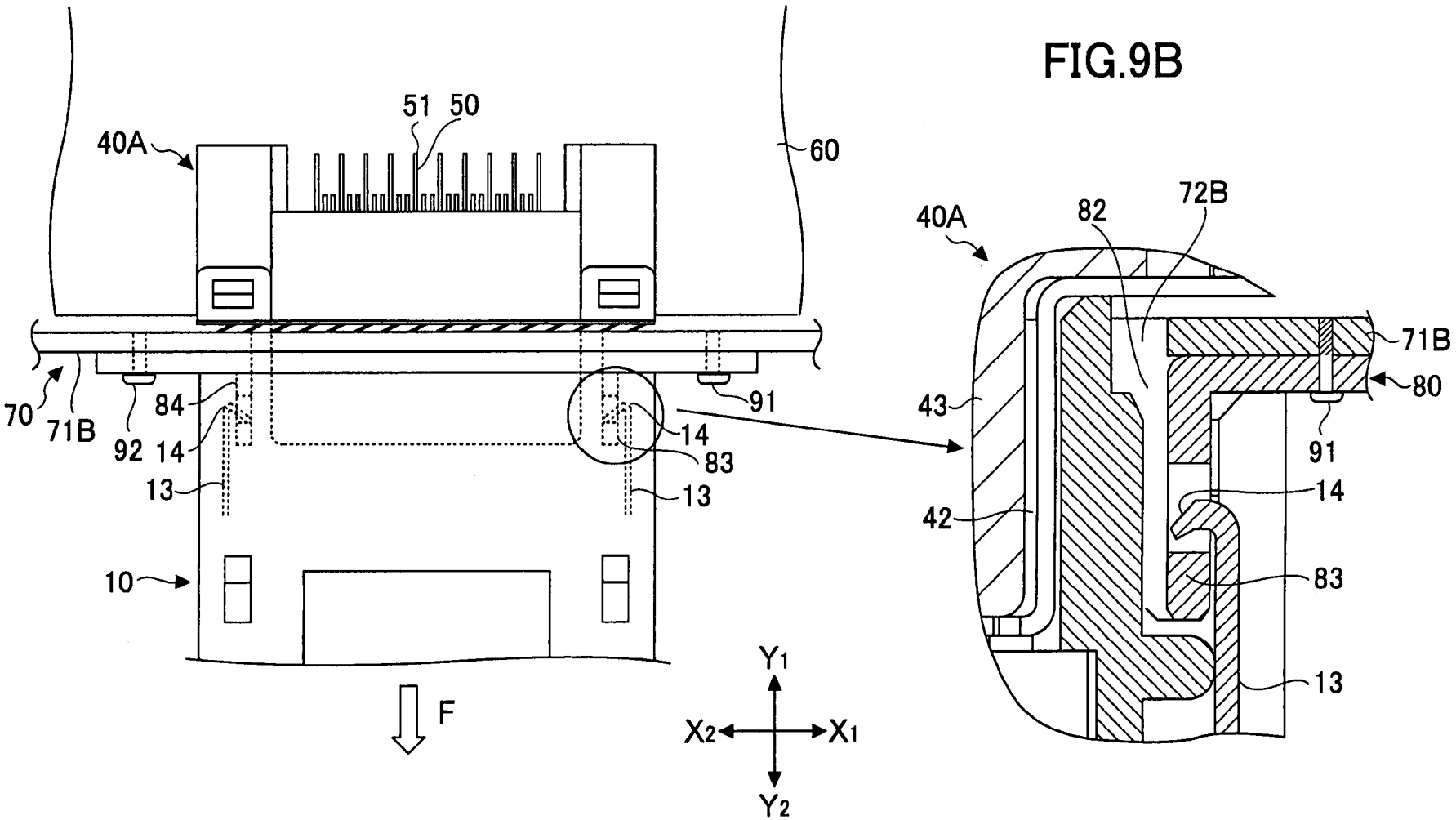
FIG. 9A is a plan view showing a state where the cable-side connector is connected to the board-side connector and is latched.
FIG. 9B is an enlarged cross-sectional view of part of FIG. 9A according to the second embodiment of the present invention.

FIGS. 7 and 8 are diagrams for illustrating a connector connection structure according to a second embodiment of the present invention, showing the cable-side connector 10 and the board-side connector 40A. FIG. 9A shows a state where the cable-side connector 10 is connected to the board-side connector 40A. FIG. 9B is an enlarged view of the circled part of FIG. 9A.

The connector connection structure according to the second embodiment of the present invention is different from the connector connection structure according to the first embodiment of the present invention in that a latch metal member 80 is provided.

As a result of providing the latch metal member 80, a panel 71B of the housing 70 of the electronic apparatus does not have the above-described latch metal parts 73 and 74. An opening 72B corresponding in size to the connector main body part 43 is formed in the panel 71B.

The latch metal member 80 includes a rectangular frame part 81 and latch metal parts 83 and 84. The frame part 81 includes an opening 82 corresponding in size to the connector main body part 43. The latch metal parts 83 and 84 project in the $Y_2$ direction from the $X_1$-side edge part and the $X_2$-side edge part, respectively, of the opening 82.

This latch metal member 80 is fastened to the exterior surface of the panel 71B by screwing the $X_1$-side portion and the $X_2$-side portion of the frame part 81 with screws 91 and 92, respectively, with the opening 82 being aligned with the opening 72B.

As shown in FIG. 8, the printed board 60 on which the board-side connector 40A is provided is incorporated in the housing 70 of the electronic apparatus, so that the connector main body part 43 projects in the $Y_2$ direction from the opening 72B and the opening 82 so as to be positioned between the latch metal parts 83 and 84.

As shown in FIGS. 9A and 9B, by pressing the cable-side connector 10 in the $Y_1$ direction against the board-side connector 40A, the insertion part 18 is fitted into the recess 44 so that the contacts of the cable-side connector 10 come into contact with the corresponding contacts 51 of the board-side connector 40A, and the enclosure part 31 is fitted around the connector main body part 43. Thus, the cable-side connector 10 is connected to the board-side connector 40A with the hook parts 14 being engaged with and latched to the latch metal parts 83 and 84.

Even when the cable 11 is pulled, the cable-side connector 10 is not removed from the board-side connector 40A because the hook parts 14 are engaged with the latch metal parts 83 and 84. If the cable 11 catches something and is pulled improperly hard, this force F acts on the latch metal parts 83 and 84, and is prevented from acting on the board-side connector 40A. Therefore, no unwanted force acts on the soldered part of the other ends 51 of the contacts 50 and the pads on the printed board 60, so that the electrical connection between the contacts 50 and the printed board 60 is maintained with high reliability.

The cable-side connector 10 and the board-side connector 40A may form a connector assembly with the illustrated connection structure.

According to one aspect of the present invention, a latch claw of a cable-side connector is latched to the panel of an electronic apparatus. Therefore, even if a cable is pulled improperly hard, the force is received by the panel of the electronic apparatus, and does not reach a board-side connector provided at an end of a printed board of the electronic apparatus. Accordingly, the soldered part of the board-side connector and the printed board (that is, part of the board-side connector soldered to the printed board and part of the printed board soldered to the board-side connector) is prevented from being adversely affected.

The present invention is not limited to the specifically disclosed embodiments, and variations and modifications may be made without departing from the scope of the present invention.

The present application is based on Japanese Priority Patent Application No. 2005-299748, filed on Oct. 14, 2005, the entire contents of which are hereby incorporated by reference.

What is claimed is:

1. A connector assembly, comprising:

a first connector provided at an end of a printed board of an electronic apparatus, the first connector having a connector main body part thereof projecting through an opening in a panel of the electronic apparatus;

a second connector provided at an end of a cable, the second connector being connectable to the connector main body part of the first connector; and a latch part to which a latch claw of the second connector is engaged, the latch part being provided on the panel and positioned so upon the latch claw of the second connector being engaged to the latch part on the panel the second connector is connected to the first connector and an engaged latch part and latch claw are within a main body part of the second connector, and the latch part is integral with the panel and formed by bending a part of the panel connected to an edge of the opening;

a pair of latch parts integral with and extending in parallel in a common plane from the panel;

the second connector comprising a pair of latch claws extending in parallel and lying in the common plane and in a direction in alignment with the pair of latch claws of the second connector;

the latch claws of the second connector being resiliently flexible in opposite directions transverse to the alignment direction, to releasably engage corresponding latch claws of the first connector to releasably connect same to the first connector;

the engaged latch part and latch claw are inside a space between a shield cover assembly and an enclosure part of the second connector, the enclosure part fitted around the connector main body part of the first connector.

* * * * *